US006149405A

United States Patent [19]

Abe et al.

[11] Patent Number: 6,149,405

[45] Date of Patent: Nov. 21, 2000

[54] DOUBLE WRAP DRY SCROLL VACUUM PUMP HAVING A COMPRESSED GAS COOLING PASSAGE DISPOSED IN THE SCROLL SHAFT

[75] Inventors: Tetsuya Abe; Seiji Hiroki, both of Naka-machi; Shuji Haga, Yokohama, all of Japan

[73] Assignees: Anest Iwata Corporation; Japan Atomic Energy Research Institute, both of Tokyo, Japan

[21] Appl. No.: 09/123,289

[22] Filed: Jul. 28, 1998

[30] Foreign Application Priority Data

Jul. 28, 1997 [JP] Japan ..... 9-217050

[51] Int. Cl.[7] ..... F04B 17/00

[52] U.S. Cl. ..... 417/420; 418/55.2; 418/94

[58] Field of Search ..... 417/420; 418/55.2, 418/60, 94

[56] References Cited

U.S. PATENT DOCUMENTS

| | | | |
|---|---|---|---|
| 4,192,152 | 3/1980 | Armstrong et al. | 62/402 |
| 4,424,010 | 1/1984 | McCullough | 417/420 |
| 4,802,831 | 2/1989 | Suefuji et al. | 418/55.2 |
| 5,024,589 | 6/1991 | Jetzer et al. | 418/55.3 |
| 5,037,278 | 8/1991 | Fujio et al. | 418/55.2 |
| 5,145,344 | 9/1992 | Haga et al. | 418/55.2 |
| 5,258,046 | 11/1993 | Haga et al. | 418/55.2 |
| 5,443,374 | 8/1995 | Yoshii et al. | 418/55.1 |
| 5,584,678 | 12/1996 | Hirooka et al. | 418/55.2 |
| 5,743,719 | 4/1998 | Haga et al. | 418/15 |
| 5,755,564 | 5/1998 | Machida et al. | 418/55.2 |
| 5,842,843 | 12/1998 | Haga | 418/55.2 |

FOREIGN PATENT DOCUMENTS

| | | |
|---|---|---|
| 0 754 860 | 1/1997 | European Pat. Off. . |
| 3-61684 | 3/1991 | Japan . |
| 08219067 | 8/1996 | Japan . |
| 08261180 | 10/1996 | Japan . |
| 96/02799 | 2/1996 | WIPO . |

*Primary Examiner*—Charles G. Freay
*Assistant Examiner*—Robert Z. Evora
*Attorney, Agent, or Firm*—Evenson, McKeown, Edwards & Lenahan, P.L.L.C.

[57] ABSTRACT

A double-wrap dry scroll vacuum pump for use as a vacuum pump for nuclear power equipment. The pump has a pump body including a suction port capable of being communicated with a vessel to be evacuated and a discharge port for discharging wrap compressed gas to an outside of the pump body after an operation of gas compression by the progressive volume reduction of a sealed space, formed by a revolving scroll and a pair of stationary scrolls. The pump further includes a pair of enclosing members which cover opposite end portions of a drive shaft and are mounted in a gas-tight state around the revolving scroll. The pump has compressed gas feed ports for feeding compressed gas therethrough to the enclosing members, the compressed gas having a higher pressure than the wrap compressed gas and is discharged together with the wrap compressed gas through the discharge port. To attain high performance and durability, the double-wrap dry scroll vacuum pump has a gas bearing in fluid communication with the compressed gas feed ports to rotatably support the drive shaft. A contact-less torque transmission means is implemented for transmitting torque from a driving source to the drive shaft.

9 Claims, 7 Drawing Sheets

DOUBLE WRAP DRY SCROLL VACUUM PUMP HAVING A COMPRESSED GAS COOLING PASSAGE DISPOSED IN THE SCROLL SHAFT

BACKGROUND OF THE INVENTION

1. Field of the Invention

The present invention relates to vacuum pumps used for nuclear power industry and, more specifically, to oilless double-wrap dry scroll vacuum pumps, comprising a pair of stationary scrolls and a revolving scroll, the revolving scroll being driven without contact to an external driving source.

2. Description of the Related Art

A scroll vacuum pump comprises a stationary scroll having a base and a scroll wrap formed thereon, a revolving scroll having basically the same shape as the stationary scroll, engaging said stationary scroll out of phase 180 degrees and being revolved by a crankshaft, said crankshaft and an rotation preventing mechanism. The pump operates to make vacuum the suction side of it by means of the change in volume of a crescent sealed space (i.e. a compression chamber) formed between the helical wrap of the stationary scroll and that of revolving scroll as the revolving scroll moves relative to the stationary scroll. FIGS. 7(*a*), 7(*b*), 8(*b*) and 8(*c*) illustrate the operation of the pump mechanism. In a state shown in FIG. 7(*a*), a space between the outer side of the revolving scroll wrap 150*a* and the stationary scroll wrap 151 is closed to end a suction step, thus the gas introduced through a suction port 152 in a compression chamber 153 as shown as a dotted area.

In a subsequent state shown in FIG. 7(*b*) after the phase advancement of a crankshaft (not shown) by 90 degrees, a suction step in a space 154 formed between the outer side 150*a* of the revolving scroll wrap and the inner side of the beginning portion of the stationary scroll wrap 151 sets in, a compression step sets in in the intermediate compression chamber 155, and a step of discharging through a discharging port 157 sets in in a compression chamber located at the center of the base.

FIGS. 8(*b*) and 8(*a*) show subsequent states after every 90 degree phase advancement of the crankshaft which is rotating clockwise.

With the revolving of the revolving scroll, the compression chamber 153 shown as the dotted area shift toward the center of the scroll and gradually reduced in volume to compress gas. Through the states shown in FIG. 8(*a*) and 7(*a*), the gas is discharged through the discharge port 157 which is provided in a central portion of the stationary scroll.

As shown above, the suction gas is continuously compressed, and neither suction valve nor discharge valve is necessary. As described before in FIGS. 7 and 8, the scroll vacuum pump has the following merits.

a. Since a plurality of compression chambers are formed and the suction, compression and discharging steps are executed simultaneously and continuously, the torque fluctuation is little. Hence vibration and noise are low.

b. Since a plurality of compression chambers are formed between the suction port and the discharging port, the pressure difference among adjacent compression chambers is low. Hence gas being compressed does not leak greatly.

c. As the radius of motion of movable part is small and the speed of frictional motion is low the wear resistance is high.

Furthermore, the number of components of the pump is small.

The scroll vacuum pump mentioned above is of a single wrap dry type. Recently, a double wrap dry type vacuum pump, which comprises a revolving scroll having a base supported on a crank shaft and a pair of scroll wraps provided on the both sides of the base in the axial direction thereof, and a pair of stationary scrolls each having a scroll wrap engaged with each of the both scroll wraps of the said revolving scroll, tends to be used owing to their superior efficiency.

Generally in a scroll fluid machine including a scroll compressor, fluid sucked from the outer periphery is compressed in sealed spaces formed between the stationary and revolving scrolls as it is successively carried toward the machine center, and the compressed fluid is discharged from the center part.

This machine, compared to other types of compressors, exerts high efficiency as it has such merits that the compression process is continuous, neither suction valve nor discharging valve is necessary, the torque fluctuation is little, leakage from compression chambers is not great. Furthermore the speed of frictional motion of frictional part is low, and the number of components is small. Fields of its application to utilize its high efficiency, low vibration level, low noise level and high reliability are being developed, and it is utilized not only in coolant compressors but also in air compressors, helium compressors and vacuum pumps for nuclear power purposes.

Meanwhile equipment of nuclear power industry is required to perfectly prevent it's influence on other related equipment and to be highly durable and reliable.

The nuclear power equipment, unlike general equipment, is necessary to exert high performance and high reliability. Particularly, environmental pollution by radioactive substances owning to related nuclear power equipment during operation should perfectly be prevented. In addition, it is required to form a boundary zone which is isolated from external environments and in which external environments can not affect other equipment connected to the said equipment.

For the above reasons, vacuum pumps used for vacuum vessels in nuclear power industry are requisite to prevent radioactive pollution during operation and have radioactive resistance and wear resistance so as not to deteriorate constituents of the equipment. It is thus necessary to select isolating means and cooling means by taking the above requirements into considerations. Particularly, it is required to ensure high degree of vacuum, ensure getting rid of various troubles due to oil and provide satisfactory seal structure, bearing structure for long-term non-stop operation.

SUMMARY OF THE INVENTION

While the present invention was made in view of the above background, the object of invention is to provide an oil-free double-wrap dry scroll vacuum pump having;

1) a gas-tight structure which isolates a pump body from the outside and a structure for preventing leakage of gas from a compression passage to the outside of the pump in order to eliminate radioactive pollution during operation, 2) an oilless bearing for securing improved durability thereof, attaining long-term non-stop operation and preventing deterioration of the heat transfer performance due to intrusion of oil in low pressure parts of the pump and 3) an efficient cooling mean.

For furtherance of an above object, the present invention features the following:

a) To attain the structure described in 1) above, indirect torque transmitting means such as a magnetic coupling for separating the pump body from driving mechanism are provided.

b) To attain the functions described in (2) and (3), a gas bearing is adopted, and gas passing through a passage in the gas bearing is effectively utilized for the cooling of a revolving scroll drive shaft.

Specifically, an object of the inventions is to provide a double-wrap dry scroll vacuum pump, which has a specific sealed structure of the pump body suitable as a vacuum pump for nuclear power equipment.

Another object of the invention is, in addition to meeting the above-mentioned object of the invention, to provide a double-lay dry scroll vacuum pump, which has a specific coupling structure of contact-less torque transmission means.

A further object of the invention is, in addition to meeting the above-mentioned object of the invention, is to specify the structure of frictional parts inside the pump body.

A still further object of the invention is, in addition to meeting the above-mentioned object of the invention, to provide a double-wrap dry scroll vacuum pump, in which compression chambers formed by a revolving scroll and stationary scrolls engaged therewith in the pump are specified such as to have a constitution necessary for gas-tight structure and sufficient wear resistance.

A yet further object of the invention as is, in addition to meeting the above-mentioned object of the invention, to provide a double-wrap dry scroll vacuum pump, which has specific bearing structures for the drive shaft, the revolving scroll and so forth.

A yet another object of the invention is, in addition to meeting the above-mentioned object of the invention, is to provide a double-wrap dry scroll vacuum pump, which has a specific bearing structure of the drive shaft.

A further object of the invention is, in addition to meeting the above-mentioned objects of the invention is, to provide a double-wrap dry scroll vacuum pump, which has a specific structure of cooling means for the drive shaft.

A further object of the invention, is to provide a double-wrap dry scroll vacuum pump, which has a specified structure cooling means for the stationary scrolls.

A further object of the invention is, in addition to meeting the above-mentioned object of the invention, to provide a double-wrap dry scroll vacuum pump, in which the revolving scroll has a specific structure for balancing the pressures in compression chambers on its axially both sides.

A further object of the invention is, in addition to the above-mentioned object of the invention, is to provide a double-wrap dry scroll vacuum pump, in which the revolving and stationary scrolls are made of a specific material.

According to the invention, in a double-wrap dry vacuum pump having a pump body which comprises a revolving scroll having a pair of scroll wraps on both sides of the base, a pair of stationary scrolls each having a scroll wrap engaged with each revolving scroll wrap and holding the revolving scroll on both sides, and a drive shaft penetrating a central part of each of the stationary scrolls, a central part of the revolving scroll being driven by the drive shaft, the pump body further comprises:

a suction port capable of being communication with a vessel to be evacuated;

a discharge port for discharging compressed gas, compressed by means of progressive volume reduction of sealed spaces formed by the revolving and stationary scrolls, to the outside of the pump body;

a pair of enclosing members mounted to the revolving scroll in a gas-tight state, covering both end portions of the drive shaft;

compressed gas feed ports for feeding compressed gas to the enclosing members, the compressed gas being discharged together with the wrap compressed gas through the discharge port and having higher pressure than the wrap compressed gas;

a contact-less torque transmission means for transmitting torque from a driving source to the drive shaft; and a gas-tight structure except for the suction, discharge and compressed gas feed ports.

According to the present invention, as shown in FIG. 1, a pump body 10 has a pair of enclosing members 31 and 35, which enclose end portions of a drive shaft 17 for driving the revolving scroll and are mounted on the stationary scrolls in a gas-tight state thereto, compressed gas feed ports 34 and 36 for feeding compressed gas having higher pressure than the wrap compressed gas into the enclosing member 31 and 35, and a contact-less torque transmission means (or magnetic coupler) 45 for transmitting torque from a drive 40 to the drive shaft 17. The pump body 10 is thus gas-tight from the side of the torque transmission means, and no contaminant material leaks form the suction side to the outside.

In addition, since compressed gas of higher pressure than the wrap compressed gas is supplied from the compressed gas feed ports 34 and 36 to the drive shaft ends and discharged through the discharge port 16, the wrap compressed gas in sealed spaces formed by the wraps does not reversely flow to the compressed gas feed ports 34 and 36.

Furthermore, since the pump body is constructed gas-tight except for the suction, discharge and compressed gas feed ports, it is possible to perfectly eliminate radioactive pollution from nuclear power equipment side connected to the suction side.

It is another effective way of the present invention to couple indirectly to the driving source via a magnetic coupling as a contact-less torque transmission mean.

With the magnetic coupling 45 provided as indirect torque transmission means for indirectly coupling the drive shaft 17 of the pump body having the perfectly gas-tight structure and the outside drive to each other, it is possible to obtain necessary drive torque control without possibility of spoiling the perfectly gas-tight structure.

It is a further effective way according to the invention to make at least frictional parts in the pump body of a metallic material.

Desirably, the tips of the scroll wraps are each in frictional contact with the other mirror finished surface through a tip seal member made of metallic, low frictional coefficient material.

By making the frictional parts, such as the drive shaft and the wrap tips, of metallic material, it is possible to improve the wear resistance and the durability.

When the tip seal members provided in the tips of the scroll wraps consist of metallic low frictional coefficient material, it is possible to ensure high gas tightness and low frictional resistance of the compression chambers, which are formed by the tip portions of the scroll wraps of the revolving and stationary scrolls. Thus, not only low torque operation is obtainable, but also the durability can be improved.

It is a still further effective way according to the invention to provide a dry bearing through which the drive shaft and the revolving scroll are revolved.

By adopting an oilless or dry bearing, i.e., an oilless metal bearing using a solid lubricant material, as one or more bearings inside the perfect gas-tight structure, it is possible to eliminate leakage of lubricant oil to surroundings and mixing of oil in the discharged gas, improve the durability of the bearing and dispense with otherwise necessary maintenance. Thus, it is possible to obtain long-term non-stop operation.

It is a yet further effective way according to the invention to rotatably support the drive shaft via a contact-less bearing and also support the drive shaft via a gas bearing operable by compressed gas fed from the compressed gas feed ports.

By supporting the drive shaft 17 via a contact-less bearing such as a gas bearing and a magnetic bearing, it is possible to improve the durability of the bearing and permit long-term non-stop operation.

Furthermore, in order to enable the drive shaft and the revolving scroll to revolve through a gas bearing which works by means of compressed gas fed from the compressed gas feed ports 34 and 36, compressed gas of higher pressure than the wrap compressed gas is fed from the compressed gas feed ports 34 and 36 to the drive shaft ends and discharged through the discharge port 16. Thus, no wrap compressed gas inversely flows from the sealed spaced formed by the wraps and no contaminant material leaks from nuclear power equipment connected to the suction side to the outside.

It is a further effective way according to the invention to provide the drive shaft with an inner cooling passage, which compressed gas fed from the compressed gas feed ports passes through, and which is communicated with the discharge port for discharging a compressed gas to the outside of the pump body in an operation of gas compression with progressive volume reduction of sealed spaces formed by the revolving and stationary scrolls.

Since the drive shaft 17 supports and revolves the revolving scroll, it can be provided with the passage of the compressed gas fed from the compressed gas feed ports 34 and 36. Thus, cooling means can be provided within the drive shaft for cooling compressed gas, which becomes hot as a result of compression after suction form the suction port during operation, efficiently in a discharge passage provided in a central part of the pump in the vicinity of the drive shaft. It is thus possible to cool substantially directly the revolving scroll which constitutes the drive of the scroll vacuum pump.

This arrangement effectively prevents deterioration of the bearings and seal members, provided in the drive shaft and the revolving scroll, due to high temperature gas in the sealed spaced formed by the wraps.

It is a further effective way according to the invention to form a cooling water circulation passage on the outer periphery of the stationary scroll and provide cooling water circulating/cooling means for feeding cooling water to the cooling water circulation passage.

With the provision of the cooling water circulating/cooling means 37 (FIG. 2) which includes a radiator for cooling circulated water and a water circulation pump, the stationary scrolls can be efficiently cooled by circulating water through the housings of the stationary scrolls.

It is a further effective way according to the invention to form the base of the revolving scroll with a thorough hole communicating sealed spaces on both sides of the revolving scroll.

The thorough hole is desirably provided in a portion of the base near the center of the revolving scroll.

With the thorough hole 25*b* (FIG. 4) formed in the revolving scroll base to communicate the both side sealed spaces thereof, it is possible to balance the pressures of compression chambers on the both sides.

In a double-wrap scroll, a pressure difference may be generated between both side compression chambers of the scroll base to bring about a difference of the state of contact between the scroll wrap tip and the mirror finish surface of another scroll wrap. This would result in deteriorating the sealed state of high-pressure side compression chambers or deterioration of durability due to partial wear. By providing the above through hole, it is possible to balance the pressures in the axially both side compression chambers so as to ensure high vacuum at suction side by highly efficient compressing operation and improve the durability.

The through hole is desirably provided near the central part of the revolving scroll where the pressure becomes high.

It is a further effective way according to the invention to form an oxide coating capable of black body radiation on the revolving and stationary scrolls.

The revolving and stationary scrolls are in vacuum and does not fully contact with other parts. Therefore, their heat conduction path is scarce, and their cooling by heat conduction can not be expected.

The oxide coating is formed on the revolving and stationary scrolls so as to absorb radiated heat by black body radiation and to facilitate transfer of heat, thus permitting cooling during driving of the revolving scroll or from the back surfaces of the stationary scrolls. In addition, the oxide coating can improve the wear resistance and the corrosion resistance.

Figure 1:
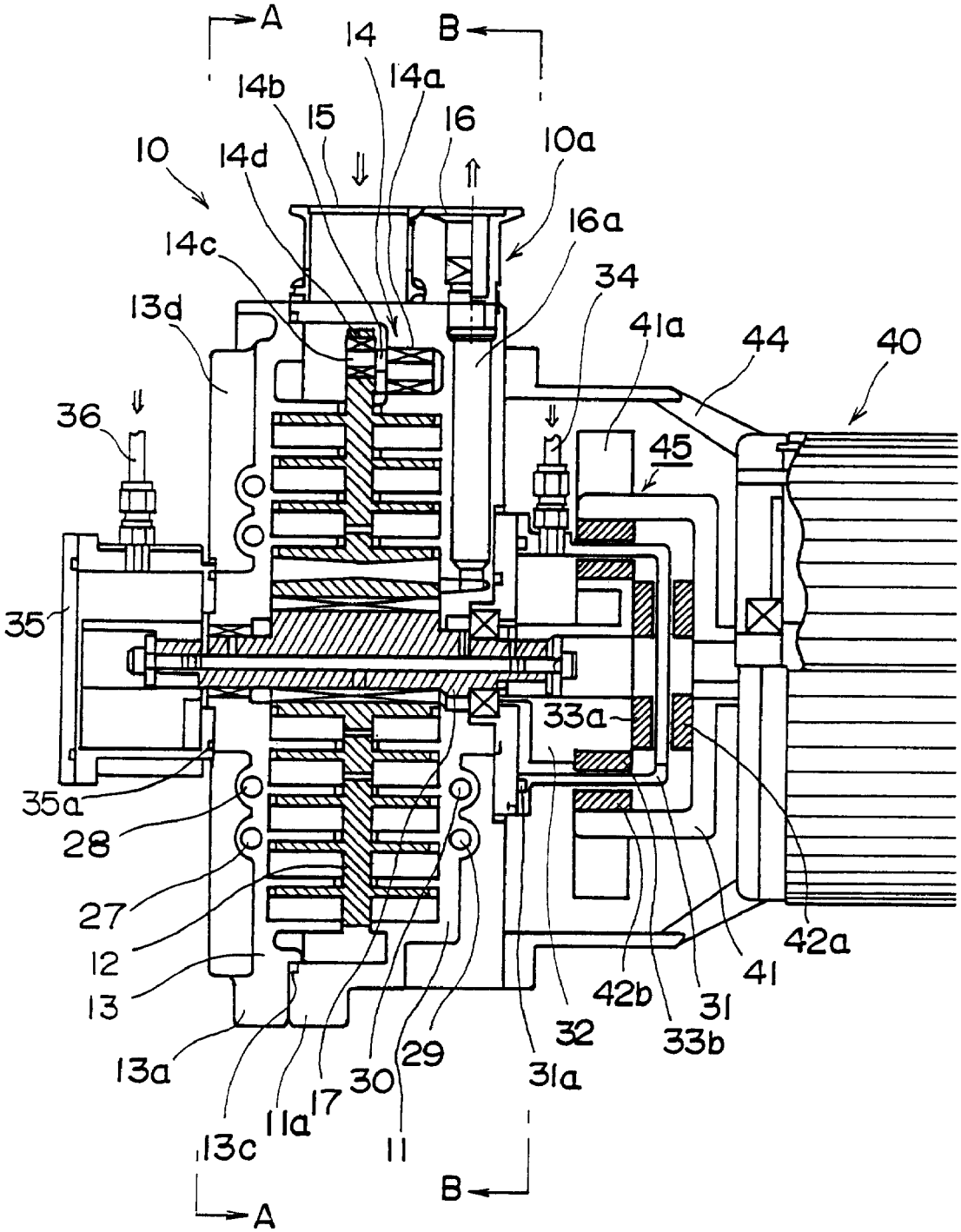
FIG. 1 is a schematic sectional view showing a double-wrap dry scroll vacuum pump embodying the invention.

In the drawings, 10 designates a pump body, 11 and 13 stationary scrolls, 12 a revolving scroll, 15 a suction port, 16 a discharge port, 16*a* and 25*b* discharge passages, 17 a drive shaft, 22 a cooling passage, 25*b* a through passage, 17 a drive shaft, 22 a cooling passage, 25*b* a thorough hole, 27 to 30 cooling jackets, 31 and 35 enclosing walls, 34 and 36 compressed gas feed ports, 37 a cooling water circulating/cooling means, and 45 a magnetic coupling (contact-free torque transmission means).

DETAILED DESCRIPTION OF THE PREFERRED EMBODIMENTS

Preferred embodiments of the present invention as illustrated in the drawings will now be described in details. It is to be construed that, unless particularly specified, the sizes, materials, shapes, relative dispositions and so forth of components described in the embodiments have no sense of limiting the scope of the invention, but are merely examplary.

Figure 2:
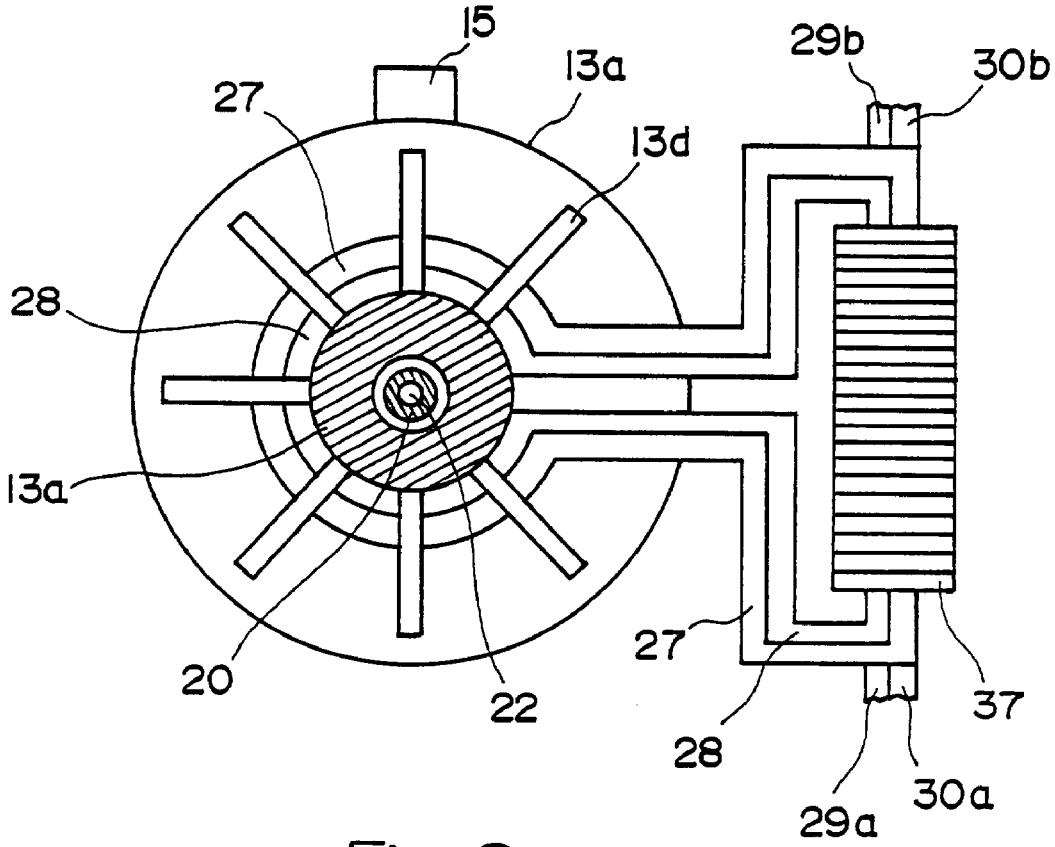
FIG. 2 is a sectional view taken along line A—A in FIG.
Figure 3:
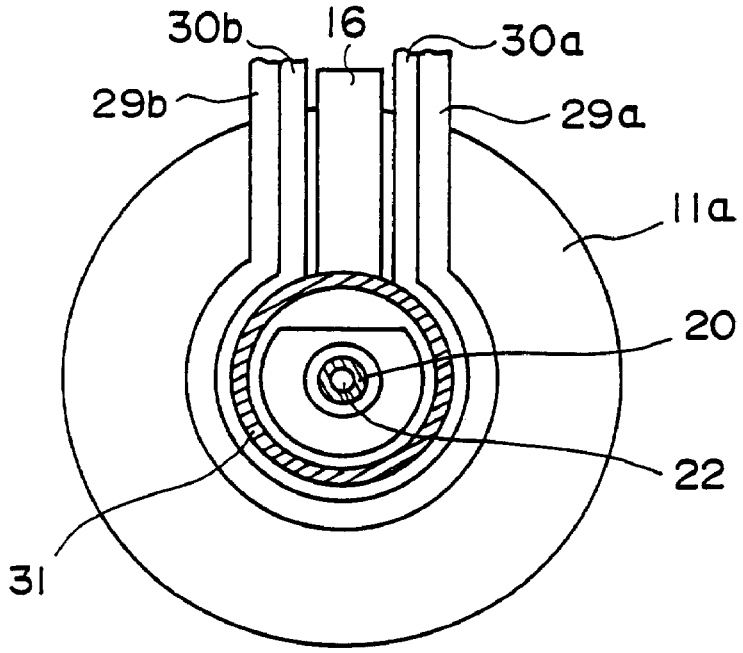
FIG. 3 is a sectional view taken along line B—B in FIG. 1.
Figure 4:
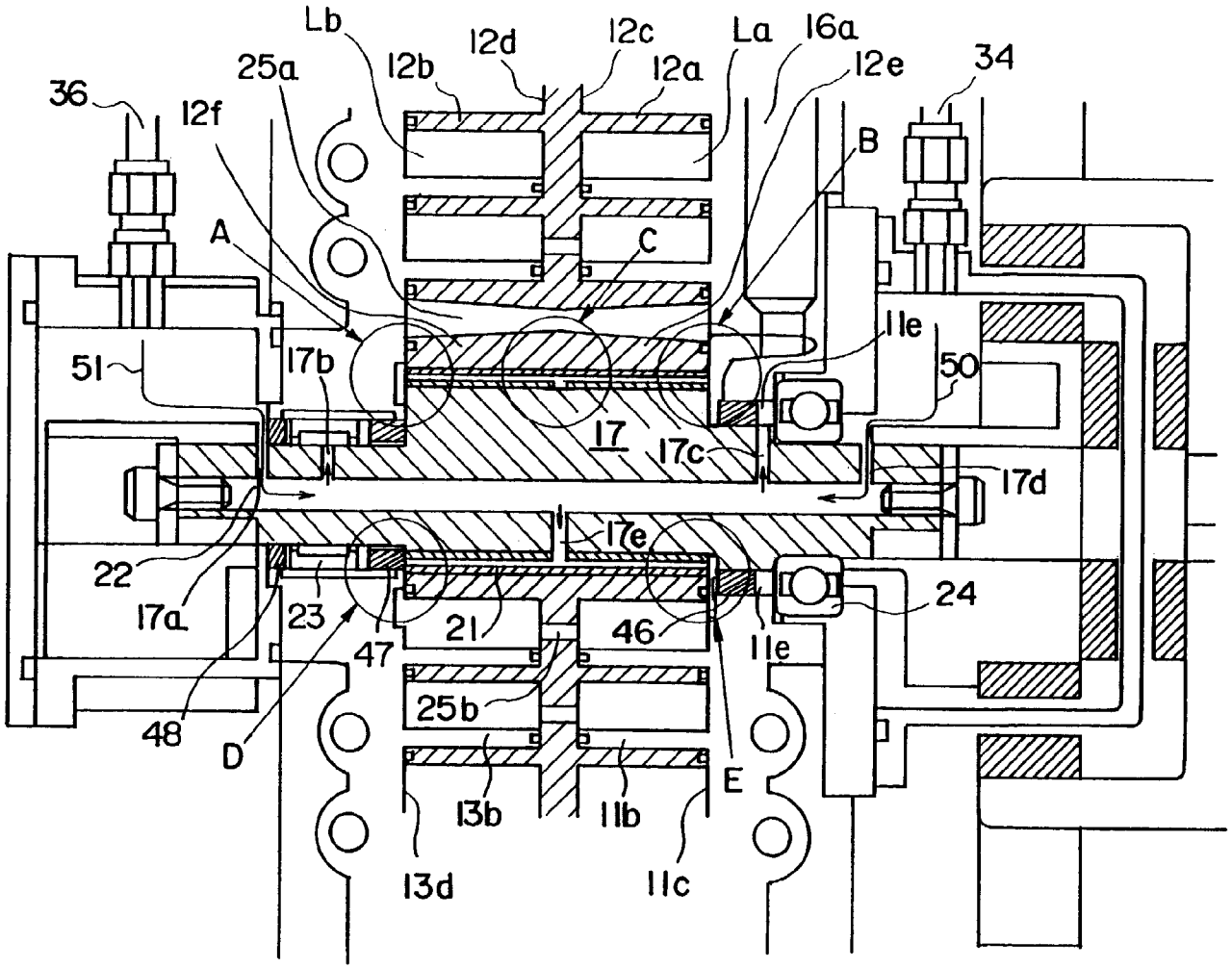
FIG. 4 is a sectional view showing an essential part in FIG. 1.
Figure 5A:
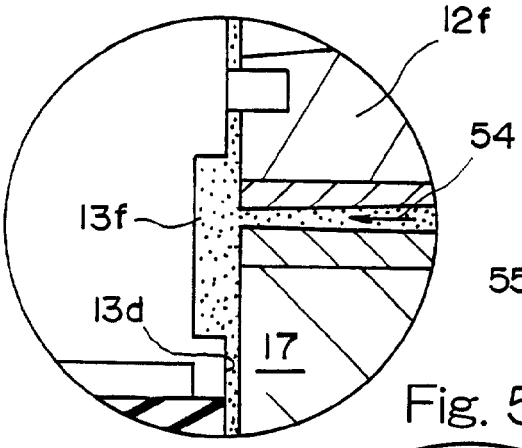
FIGS. 5(*a*) to 5(*e*) are enlarged-scale views showing parts in FIG. 4.
Figure 5B:
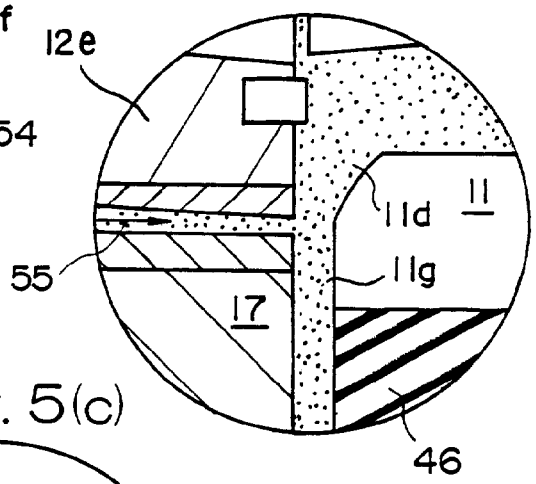
Figure 5C:
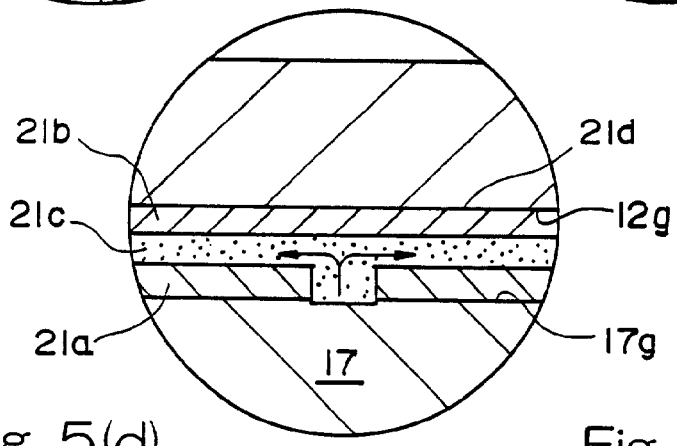
Figure 5D:
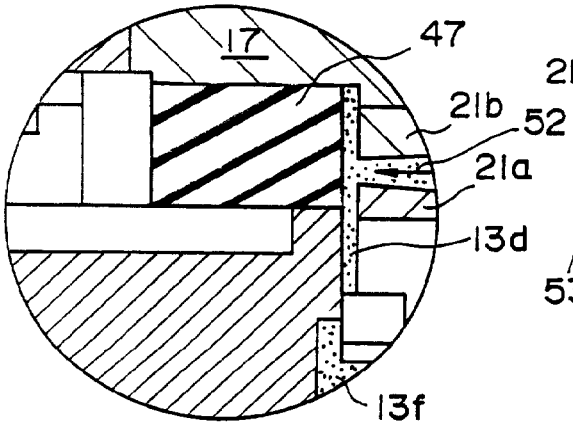
Figure 5E:
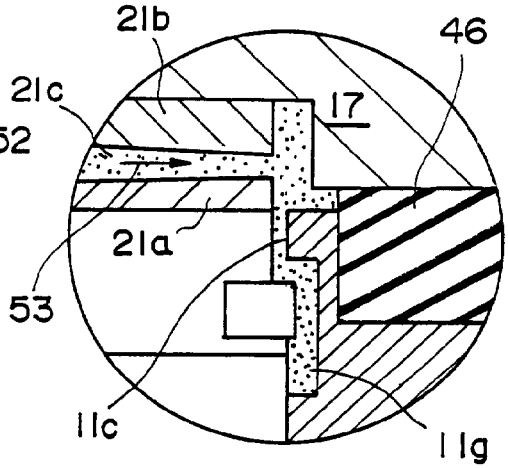

FIG. 1 is a schematic sectional view showing a doublep wrap dry scroll vacuum pump embodying the present invention. FIG. 2 is a sectional view taken along line A—A. FIG. 3 is a sectional view taken along line B—B. FIG. 4 is a sectional view showing an essential part shown in FIG. 1. FIG. 5(*a*) to 5(*b*) are enlarged-scale views, showing parts shown in FIG. 4.

As shown in FIG. 1, the illustrated double-wrap dry scroll vacuum pump according to the present invention comprises a pump body 10 including a scroll compressor 10*a* and enclosing walls 31 and 35, and a motor 40.

The scroll compressor 10*a* is made of aluminum or like metal, and includes a stationary scroll 11, a revolving scroll 12 and a stationary scroll 13.

The stationary scroll 11 has a cylindrical cap-like housing 11*a* having an axially perpendicular frictional surface 11*c* (FIG. 4) and a scroll wrap 11*b* embedded axially to the frictional surface. The stationary scroll 13 also has a cylindrical cap-like housing 13*a* having an axially perpendicular frictional surface 13*d*, and a scroll wrap 13*b* embedded axially to the frictional surface. The revolving scroll 12 is eccentrically supported on a drive shaft 17 via a bearing 21, and has both side frictional surfaces 12*c* and 12*d* and scroll wraps 12*a* and 12*b* each embedded axially to each of the frictional surfaces.

The housing 11*a* has a discharge port 16, a suction port 15 having a discharge passage 16*a*, a suction port 15 and three rotation preventing mechanisms 14, these parts being disposed in the mentioned order from its substantial center toward its outer periphery.

The rotation preventing mechanisms 14 each have a bearing 14*a*, a crankwheel 14*b* supported therein and a pin 14*c* embedded in the crankwheel 14*b*. The pins 14*c* are rotatably coupled by bearings 14*d* to the outer periphery of the revolving scroll 12, and are cooperative with eccentricity of rotation of the drive shaft 17, whereby the revolving scroll 12 is revolved relative to the stationary scrolls 11 and 13 without being rotated.

The scroll wraps 12*a* and 12*b* on the both sides of the revolving scroll 12 are engaged with the scroll wraps 11*b* and 13*b* of the stationary scrolls 11 and 13, respectively. These scroll wraps 12*a* and 12*b* have their tips in frictional contact with the frictional surfaces 11*c* and 13*c*, respectively, while the scroll wraps 11*b* and 13*b* of the stationary scrolls 11 and 13 have their tips in frictional contact with the frictional surfaces 12*c* and 12*d* of the revolving scroll 12, respectively. The revolving scroll 12 is thus revolved in a state that it is eccentrically supported by the drive shaft 17 while its rotation is prohibited by the rotation preventing mechanisms 14. As the revolving scroll 12 is revolved, crescent compression chambers La and Lb are formed between the revolving scroll 12 and the stationary scrolls 11 and 13, thereby sucking gas through the suction port 15. In this way, the suction, compression and discharging steps are performed simultaneously and continuously. An vacuum pump function of suction gas through the suction port 15 and discharging compressed gas through the discharge port 16 is thus obtained.

Tip seal members of a low frictional coefficient metallic material, such as pure aluminum, duralumin, copper, sliver, gold, tin and lead, are provided in the tips of the scroll wraps 112*b*, 12*a*, 12*b* and 13*b*, thus permitting high gas-tightness formation of the crescent compression chambers La and Lb by the frictional engagement of the wraps to permit durability improvement and high vacuum degree, low torque operation.

The revolving scroll 12 and the stationary scrolls 11 and 13 are aluminum members with an oxide coating capable of black body radiation. Aluminum members coated with oxide film absorb heat effectively by thermal radiation, while the aluminum material can readily conduct heat, thus permitting cooling of the scrolls and improving the wear resistance and corrosion resistance of these members.

In the above construction, the housing 13*a* is held in contact with the housing 11*a* between which a seal member 13*c* intervenes so that the revolving scroll 12 engaged with the stationary scrolls 11 and 13 is sealed and built in gas-tightly, thus forming an inner sealed space and also forming a gas-tight sealed structure functioning as a housing.

The drive shaft 17 is rotatably connected to the central parts of cap-like flanges of the housings 11*a* and 13*a* through a ball bearing 24 (FIG. 4), which is disposed together with a shaft seal 46 on its inner side to prevent intrusion of external gas, and a bearing 23, which is disposed together with shaft seals 47 and 48 at the both sides for the same purpose. The drive shaft 17 is a crankshaft having a eccentric portion. A bearing 21 is provided on the eccentric portion, to which the revolving scroll 12 is rotatably connected.

As shown in FIG. 4, the drive shaft 17 has an axial cooling passage 22. Compressed gas is fed from compressed gas feed ports 34 and 36 through feed passages 17*a* and 17*d* to the cooling passage 22 for cooling the drive shaft 17, then led through a discharge passage 17*e* into the bearing 21, and discharged through a discharge port lid (FIG. 5(*b*)) of the stationary scroll 11 into a discharge passage 16*a*.

The compressed gas fed from the compressed gas feed ports 34 and 36 is inert nitrogen gas and has higher pressure than the pressure of wrap compressed gas, which is compressed to the final stage from the sealed space formed in the resolving and stationary scrolls present to be discharged through the discharge port 16. Thus, the wrap compressed gas will not inversely flow to the compressed gas feed ports 34 and 36.

The drive shaft 17 also functions as a gas bearing, and the vicinity thereof will now be described with reference to FIGS. 4 and 5(*a*) to 5(*d*). Referring to FIG. 4, gas fed through the compressed gas feed ports 34 and 36 to the cooling passage 22 in the dive shaft 17 as shown by arrows 50 and 51, cools the drive shaft 17, and is then led into the bearing 21 through a passage 17*e* formed in a central portion of the bearing 21.

As shown in FIG. 5(*c*), the bearing 21 has an inner rim 21*a* and an outer rim 21*b* spaced apart by a predetermined gap 21*c*. The inner rim 21*a* is fitted on and secured to the outer periphery 17*g* of the drive shaft 17. The outer rim 21*b* has its outer periphery 21*d* slidably fitted in a central bore 12*g* of the drive shaft 17. The gap 21*c* has reducing cross-sectional areas as it goes from its central part toward the opposite open ends.

As shown in FIGS. 5(*a*) and 5(*d*), the frictional surface 13*d* of the stationary scroll 13, facing the left end of the bearing 21, has a recess 13*f*. As shown in FIGS. 5(*b*) and 5(*e*), the frictional surface 11*c* of the stationary scroll 11 facing the left bearing end has a recess 11*g* communicated with the discharge port 11*d*.

Compressed gas fed through the compressed gas feed ports 34 and 35 passes through the cooling passage 22 to enter the passage 21*c* in the bearing 21 and to be partly led to the left end thereof, as shown by arrow 52 in FIG. 5(*d*), thus filling the spaces between the shaft seal 47 and the frictional surface 3*d* of the stationary scroll 13 and between the inner and outer rims 21*a* and 21*b* of the bearing 21. This has an effect of providing floating of the drive shaft 17 and the revolving scroll 12 together with the bearing 21.

The compressed gas entering the passage 21*c* is partly led to the right end of the bearing 21, as shown by arrow 53 in FIG. 5(*e*), thus filling the spaces between the drive shaft 17 and the shaft seal 46 on one hand and the frictional surface 11*c* of the stationary scroll 11 on the other hand and also between the inner and outer rims 21*a* and 21*b* of the bearing 21. This also has the effect of providing floating of the drive shaft 17 and the revolving scroll 12 together with the bearing 21.

The compressed gas entering the passage 21*c* is partly led to the left end of the bearing 21 as shown by arrow 54 in FIG. 5(*a*) and then fills the recess 13*f* provided in the frictional surface 13*d* of the stationary scroll 13, and the space between the frictional surface 13*d* and the drive shaft 187. Again this has the effect of providing floating of the drive shaft 17 and the revolving scroll 12 together with the bearing 21.

The compressed gas entering the passage 21*c* is led to the right end of the bearing 21, as shown by arrow 53 in FIG. 5(*b*),and fills the recess 11*g* provided in the frictional surface 11*c* of the stationary scroll 11 and the discharge port 11*d*. Still again this has the effect of floating the drive shaft 17 and the revolving scroll 112 together with the bearing 21. The compressed gas is discharged together with the wrap compressed gas through the discharge port 11*d* into the discharge passage 16*a*.

As shown in FIG. 4, the compressed gas entering the passage 21*c* is further led through a passage 17*c* to fill a space 11*e* provided between the shaft seal 46 and the outer ball bearing 24. Since the recess 11*g* on the inner side of the shaft seal 46 is also filled with compressed gas, the pressures on the both sides of the shaft seal 46 are equal, and no immoderate force is applied thereto.

The compressed gas entering the passage 21*c* yet further is led through a passage 17*b* to fill the bearing 23. This has an effect of floating a bored portion of the drive shaft 17 in the open space of the stationary scroll 13.

As shown in FIG. 2, the stationary scroll 13 has a cooling fin 13*d* provided in a round cap-like portion of its housing 13*a* for natural cooling with atmospheric air. As shown in FIGS. 2 and 3, the housings 11*a* and 13*a* have cooling water circulation jackets 27 to 30, while a cooling water circulating/cooling means 37 having a radiator and a water circulation pump is separately provided, for forced cooling of the stationary scrolls 11 and 13 form the back surfaces thereof.

The bearing described above, may be a gas bearing or may independently be used a solid lubricant member. As a further alternative, it is possible to use a solid lubricant member and a gas bearing in combination or use a sole magnetic bearing instead of the gas bearing.

Figure 6:
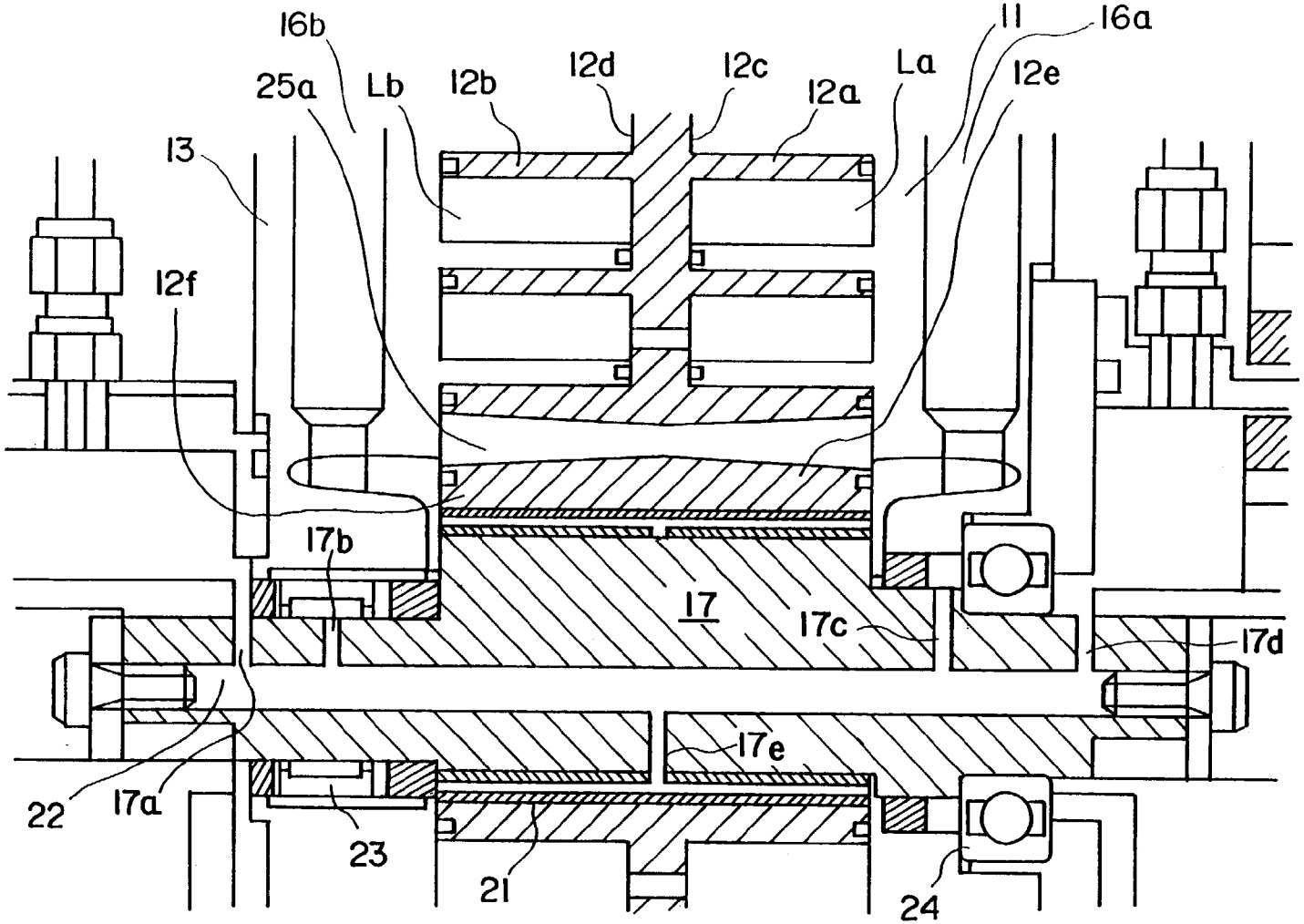
FIG. 6 is a schematic sectional view showing a different embodiment of the double-wrap dry scroll vacuum pump.
Figure 7B:
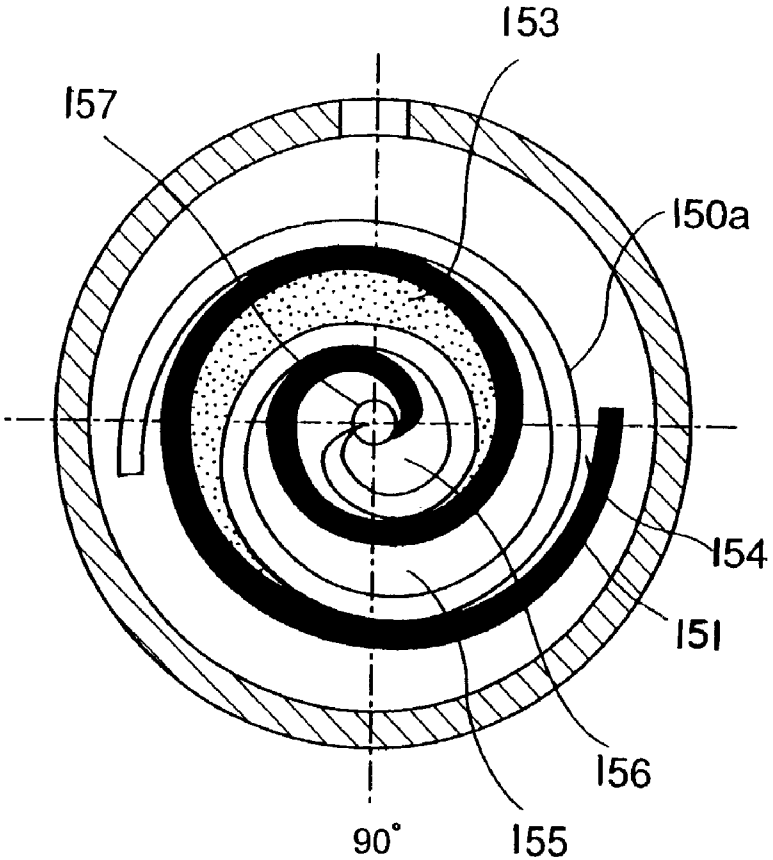
FIGS. 7(*a*) and 7(*b*) are views illustrating the transferring state from a suction step to a compressing step in a usual scroll compressor.
Figure 7A:
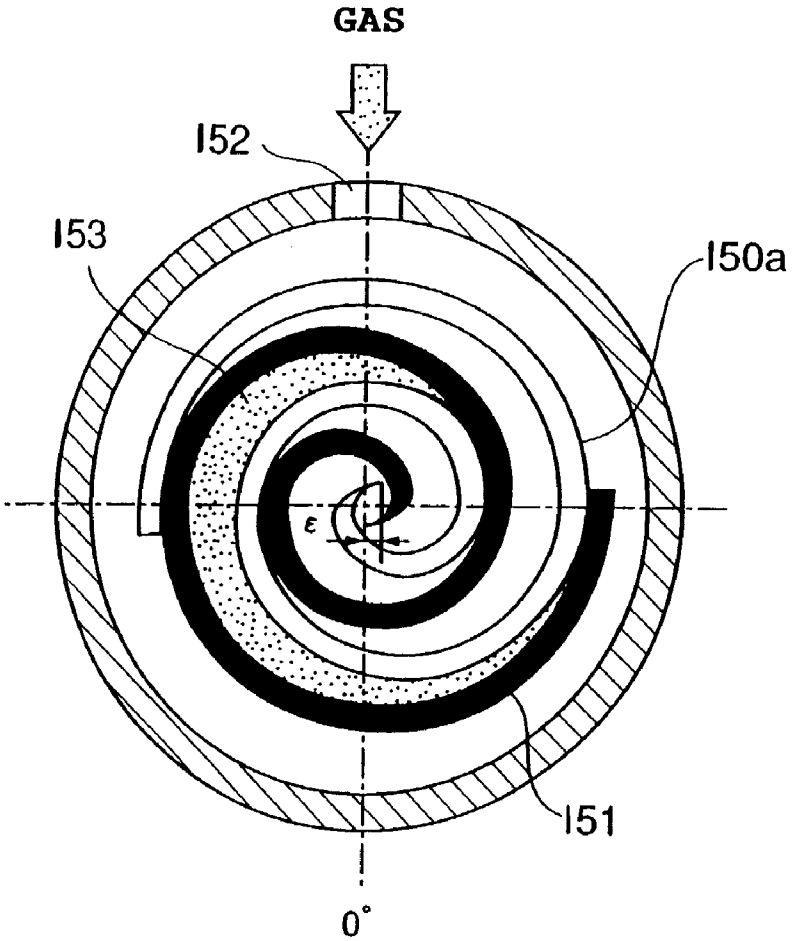
Figure 8B:
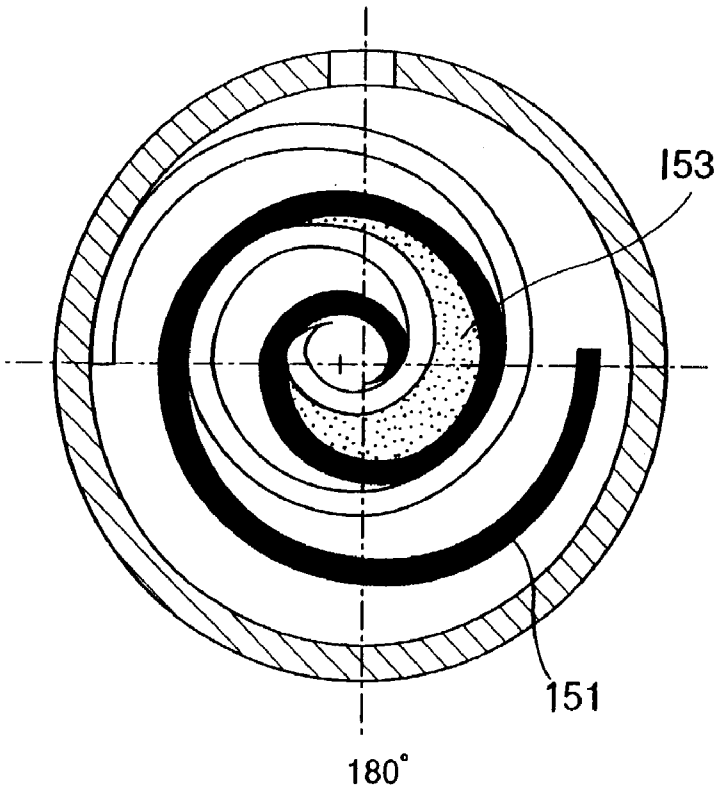
FIGS. 8(*a*) and 8(*b*) are views illustrating the transferring state from the compressing step to a discharging step in the usual scroll compressor.
Figure 8A:
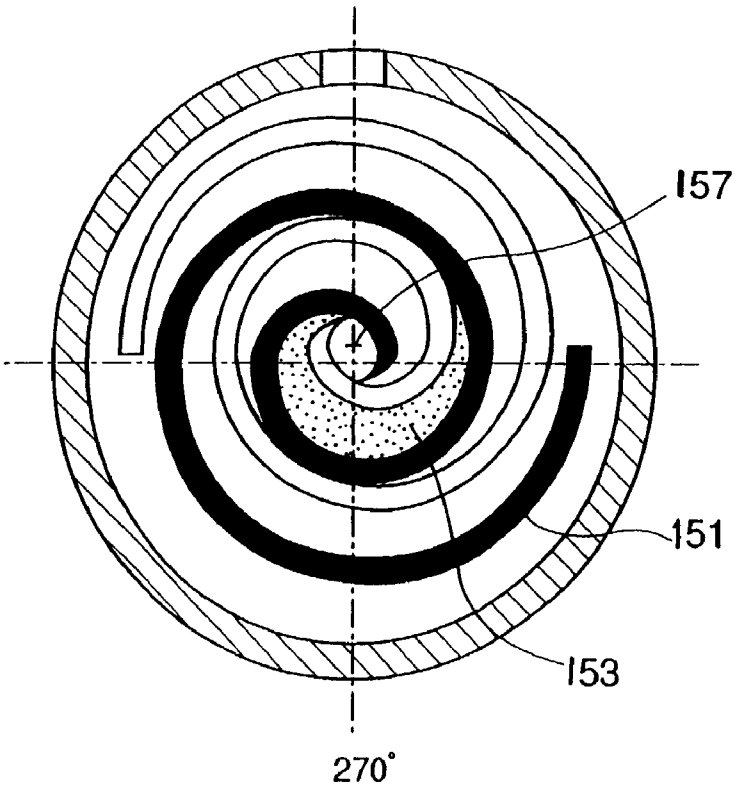

FIG. 6 is a schematic view showing a pump body in another embodiment of the present invention. This embodiment is different form the preceding embodiment shown in FIG. 4 in that, while in the preceding embodiment shown in FIG. 4 only the stationary scroll 11 is provided with only one discharge passage 16*a* for discharging wrap compressed gas, in this embodiment the other stationary scroll 13 is also provided with a discharge passage 16*b*.

In case of only a single discharge passage, the size thereof should be large for preventing discharge efficiency reduction due to mechanical loss. Another disadvantage is sacrifice of the degree of freedom of shape design in that it may be necessary to collectively provide cooling passages of the stationary scroll housings and related members in only one stationary scroll. This embodiment does not have the above disadvantages, and permits the discharge amount of wrap compressed gas on both revolving scroll sides to be flowed in the both right and left side discharge passages. It is thus possible to provide a more efficient vacuum pump.

As has been shown above, according to the present invention an oilless system can be provided by utilizing a gas bearing, a magnetic bearing, an oilless metal bearing using a solid lubricant member. It is thus possible to eliminate leakage of oil to surroundings or mixing of oil in the discharged compressed gas as might be the case in the case of using lubricant oil, improve the durability of the bearings, and eliminate otherwise necessary maintenance which is undesired from the management standpoint. Particularly, it is possible to eliminate radioactive pollution and obtain long-term non-stop operation.

Furthermore, cooling means can be provided inside the drive shaft by forming the passage of compressed gas therein, permitting high temperature compressed gas, resulting from compression of gas inhaled from the suction side during operation, to be efficiently cooled in the vicinity of the center near the drive shaft. It is thus possible to cool substantially directly the revolving scroll constituting a driving part of the scroll vacuum pump.

The above arrangement also has a great additional effect of preventing the deterioration of bearings, seal members and so forth, provided on the revolving scroll and the drive shaft as driving parts, due to high temperature gas formed in the sealed spaces between the wraps.

The above cooling means further eliminates, in combination of forced cooling of the stationary scrolls with circulated cooling water to be described later, the difference of the thermal expansion between the stationary and revolving scrolls, thus preventing scratching of the wraps to improve the durability and permit long-term non-stop operation.

Reduction of heat generation makes it further possible to decrease the clearance between adjacent scrolls by. Thus being able to operate at high rotating rate, it is also possible to obtain high vacuum.

The enclosing walls 31 and 35 are coupled to the housings 11*a* and 11*b* of the scroll compressor 10*a* in a perfect gas-tight state through seal members 31*a* and 35*a*, and form sealed spaces accommodating end portions of the drive shaft 17 projecting from the housings 11*a* and 13*a*. The compressed gas feed ports 34 and 36 are connected to the enclosing walls 11*a* and 13*a* for feeding compressed atmospheric air through the end portions of the drive shaft 17 to the cooling passage 22, thus forming the gas bearing and cooling the revolving scroll 12.

The pump body is driven by the motor 40 indirectly through a magnetic coupling 45. The magnetic coupling 45 includes magnets 33*a* and 33*b*, which are provided on an end member of the drive shaft 17 situated in the sealed space 32 formed by the enclosing wall 31, and magnets 42*a* and 42*b*, which are provided on a coupling member 41 of the drive 40.

With the above construction of the indirect torque coupling means which indirectly couples the drive shaft 17 of the pump body 10 of the perfectly gas-tight structure with the outside drive 40, a predetermined drive torque can be transmitted to the drive shaft 17 without spoiling the perfectly gas-tight structure.

The coupling member 41 of the motor 40 has a rotary vane 41*a* for ventilating heated atmosphere formed by the magnetic coupling 45 through a ventilating hole 44.

The base of the revolving scroll 12 has a thorough hole 25*b* communicating the compression chambers formed on the both sides of the revolving scroll 12 between the revolving scroll 12 and the stationary scrolls 11 and 13, thus balancing the pressures in both the final compression chambers.

The above construction permits balanced and highly efficient suction and compression of gas and can ensure high vacuum on the suction side.

As has been described in the foregoing, according to the present invention the contact-less torque transmission means based on the magnetic coupling 45 is provided between the motor 40 and the drive shaft 17, thus forming a perfectly gas-tight structure as the pump body 10 is isolated from the outside, i.e., external atmosphere, except for the suction, and discharge ports 15 and 16 and the compressed gas feed ports 34 and 36. It is thus possible to secure high vacuum and ensure perfect protection from radioactive pollution from nuclear power equipment connected to the suction side of the pump body 10.

In addition, by adopting the perfect oilless system using a gas bearing, a magnetic bearing or an oilless metal with solid lubricant, it is possible to thoroughly eliminate cumbersome problems stemming from oil.

Furthermore, by adopting balanced cooling means having superior cooling efficiencies for the inside and outside of the pump body 101, it is possible to prevent scratching of the wraps, increase the vacuum and improve the durability.

Thus, it is possible to supply an vacuum pump, which is free from pollution, is highly efficient and permits non-stop operation.

What is claimed is:

1. A double-wrap dry scroll vacuum pump having a pump body comprising:

a revolving scroll including a base and a pair of revolving scroll wraps arranged on both sides of the base, a pair of stationary scrolls each having a scroll wrap engaged with each revolving scroll wrap and holding the revolving scroll on both sides, and a drive shaft penetrating a central part of each of the stationary scrolls, a central part of the revolving scroll being driven by the drive shaft;

the pump body further comprising;

a suction port;

a discharge port for discharging compressed gas compressed by means of progressive volume reduction of sealed spaces formed by the revolving and stationary scrolls, to the outside of the pump body;

a pair of enclosing members each mounted to an external surface of one of the stationary scrolls via a sealing member and each of the enclosing members covering an end portion of the drive shaft, each of the end portions of the drive shaft being in fluid communication with one of a pair of compressed gas feed ports each located in one of the enclosing members;

a compressed gas axial cooling passage formed in the drive shaft and a compressed gas being introduced to each end portion of the drive shaft and into the axial cooling passage from each of the compressed gas feed ports, and the drive shaft further including at least one additional passage in fluid communication with the axial cooling passage for introducing the compressed gas to a bearing which supports the drive shaft; and a gas bearing in fluid communication with the axial cooling passage through a discharge passage in the drive shaft, the gas bearing operable to rotatable support the drive shaft by use of the compressed gas supplied from the compressed gas feed ports.

2. The double-wrap dry scroll vacuum pump according to claim 1, wherein the drive shaft includes an eccentric portion, and a driving source is indirectly coupled to the pump by a contact-less torque transmission including a magnetic coupling.

3. The double-wrap dry scroll vacuum pump according to claim 1, wherein tips of the scroll wraps are each in frictional contact with a finished surface of another scroll wrap by way of a tip seal member made of a metal having a low frictional coefficient.

4. The double-wrap dry scroll vacuum pump according to claim 1, wherein the drive shaft and the revolving scroll are revolved through a dry bearing including a lubricant or a magnetic bearing.

5. The double-wrap dry scroll vacuum pump according to claim 1, wherein the discharge passage in the drive shaft is formed in an eccentric portion of the drive shaft which supports the revolving scroll, the discharge passage directing compressed gas from the axial cooling passage inside the drive shaft to a space formed between inner and outer rings of the gas bearing; and a discharge Passage formed in one of the stationary scrolls for discharging the compressed gas from the space formed between inner and outer rings of the gas bearing to an outside of the pump body, together with a wrap compressed gas generated by a contraction operation of a gas-tight space formed by the revolving and the stationary scrolls.

6. The double-wrap dry scroll vacuum pump according to claim 1, wherein a cooling water circulation passage is formed on an outer periphery of the stationary scroll which includes a radiator and a cooling water circulation cooling means equipped with a water circulation pump for supplying water.

7. The double-wrap dry scroll vacuum pump according to claim 1, wherein a through hole is formed in the base of the revolving scroll for connecting sealed spaces formed on each side of the base of the revolving scroll.

8. The double-wrap dry scroll vacuum pump according to claim 1, wherein the drive shaft and tips of the scroll wraps are made of a metallic material and an oxide film capable of black body radiation is formed on the revolving and stationary scroll wraps.

9. A double-wrap dry scroll vacuum pump having a pump body comprising:

a revolving scroll including a base and a pair of revolving scroll wraps arranged on both sides of the base, a pair of stationary scrolls each having a scroll wrap engaged with each revolving scroll wrap and holding the revolving scroll on both sides, and a drive shaft penetrating a central part of each of the stationary scrolls, a central part of the revolving scroll being driven by the drive shaft;

the pump body further comprising:

a pair of enclosing members each mounted to an external surface of one of the stationary scrolls via a sealing member and each of the enclosing members covering an end portion of the drive shaft, the drive shaft being in fluid communication with compressed gas feed ports at each end portion;

a compressed gas axial cooling passage formed in the drive shaft and a compressed gas being introduced to each end portion of the drive shaft and into the axial cooling passage from each of the compressed gas feed ports, and the drive shaft further including at least one additional passage in fluid communication with the axial cooling passage for introducing the compressed gas to a bearing which supports the drive shaft;

a gas bearing for rotatively supporting the drive shaft and being in fluid communication with the axial cooling passage through at least one discharge passage formed in an eccentric portion of the drive shaft which supports the revolving scroll, the at least one discharge passage communicating compressed gas to a space between an inner and outer ring of the gas bearing;

a port formed by an end surface of the gas bearing, the revolving scroll and one of the stationary scrolls, and receiving the compressed gas from the space between the inner and outer ring of the gas bearing and directing the compressed gas to a discharge passage; and the discharge passage formed in one of the stationary scrolls for discharging the compressed gas from the port to an outside of the pump body, together with a wrap compressed gas generated by a contraction operation of a gas-tight space formed by the revolving and the stationary scrolls.

* * * * *